US005706947A

United States Patent [19]

Hodges

[11] Patent Number: 5,706,947

[45] Date of Patent: Jan. 13, 1998

[54] GIFT CONTAINER

[76] Inventor: Joseph A. Hodges, 909 N. Gardner St., Apt. 306, West Hollywood, Calif. 90046

[21] Appl. No.: 689,483

[22] Filed: Aug. 8, 1996

[51] Int. Cl.[6] ..... B65D 5/00

[52] U.S. Cl. ..... 206/457; 206/214; 229/101; 229/23 BT

[58] Field of Search ..... 206/457, 523, 206/214, 215, 232, 736; 229/101, 23 BT

[56] References Cited

U.S. PATENT DOCUMENTS

| | | | |
|---|---|---|---|
| 4,328,923 | 5/1982 | Graser | 229/101 |
| 4,722,462 | 2/1988 | Zinnbauer | 229/101 |
| 5,094,359 | 3/1992 | DeMars et al. | 229/101 |
| 5,170,889 | 12/1992 | Cue | 206/232 |
| 5,170,934 | 12/1992 | Lemoine | 229/101 |

*Primary Examiner*—Paul T. Sewell
*Assistant Examiner*—Luan K. Bui

[57] ABSTRACT

A gift container including a lid. Also, included is a bottom member. The bottom member has a base portion with four peripheral side walls integral therewith and interconnected one to another to form a box-like structure that is capable of being covered by the lid. Lastly, a plurality of holders are provided. Each holder has a front wall and a bottom end that is attached to one of the side walls of the bottom member. Each holder has a pair of accordion-like side walls that are connected to the front wall and the side walls of the bottom member.

6 Claims, 3 Drawing Sheets

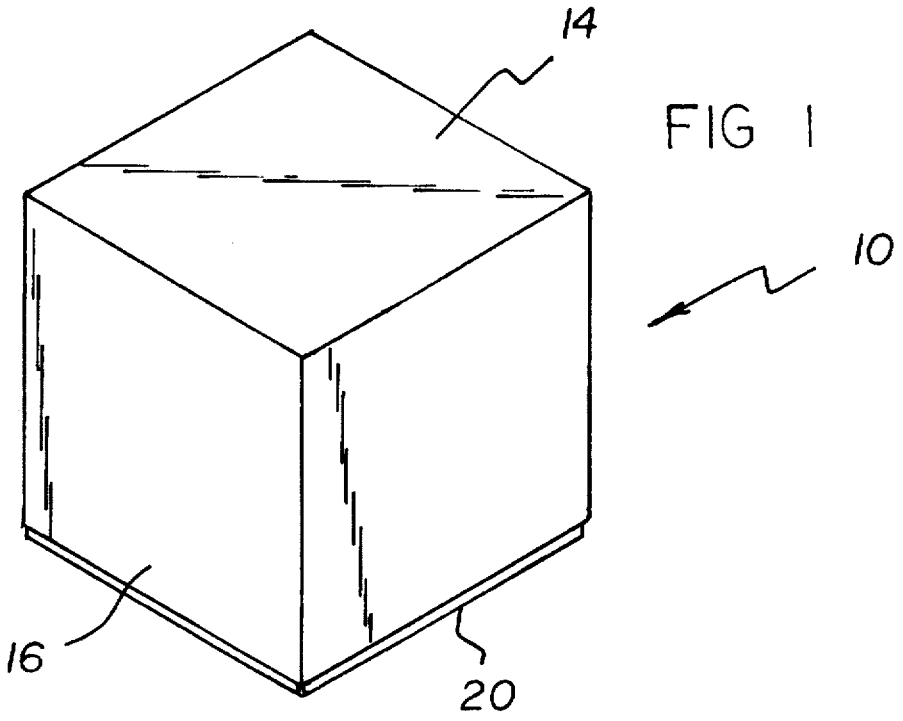
FIG 1
FIG 2
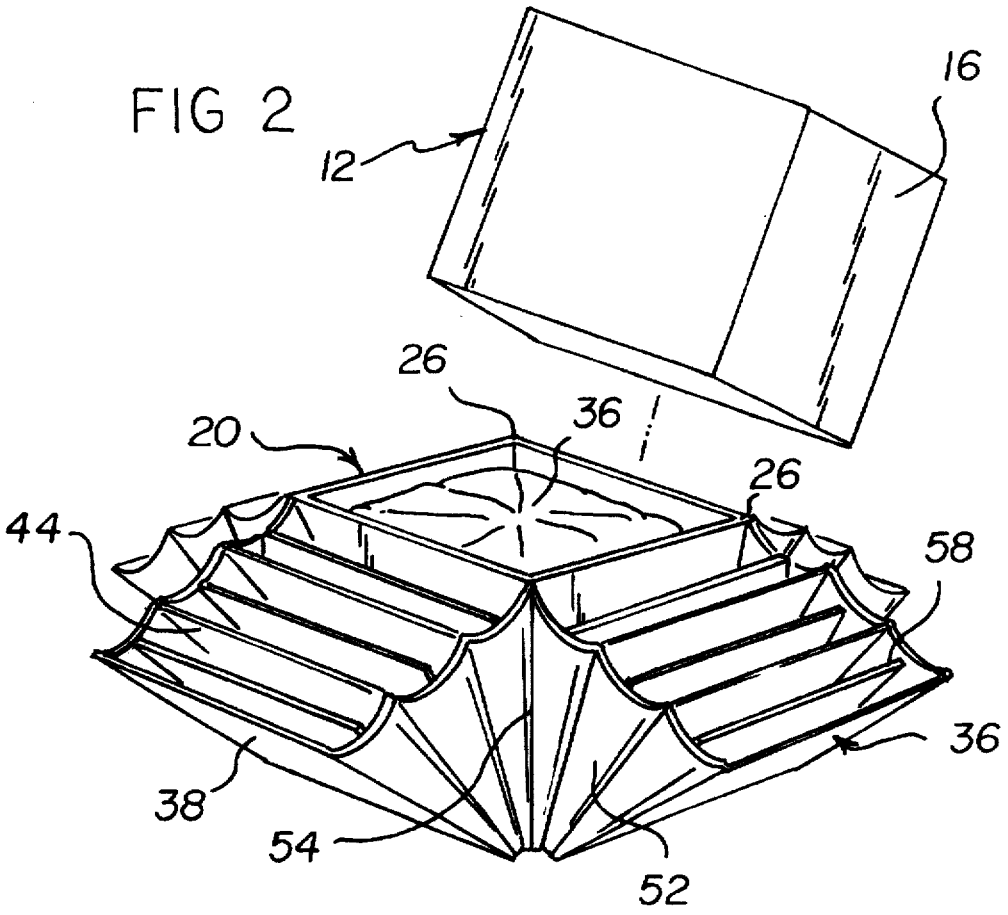

GIFT CONTAINER

BACKGROUND OF THE INVENTION

1. Field of the Invention

The present invention relates to a gift container and more particularly pertains to providing a box that holds one large gift and further including pockets for holding twelve smaller gifts.

2. Description of the Prior Art

The use of a box is known in the prior art. More specifically, boxes heretofore devised and utilized for the purpose of storage are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,765,469 to Seifert discloses a multi-sectional storage container. U.S. Pat. No. 4,284,227 to Corey discloses a expansion folder with accordian-pleat backbone. U.S. Pat. No. 5,299,688 to McKay et al. discloses a storage device and system for card collections. U.S. Pat. No. 4,488,659 to Jones discloses a collapsible container. Lastly, U.S. Pat. No. 5,014,888 to Bryan discloses a closure for a container.

While these devices fulfill their respective, particular objectives and requirements, the aforementioned patents do not describe a gift container that allows a single box to be used as a container for a plurality of gifts to be opened over a period of time.

In this respect, the gift container according to the present invention substantially departs from the conventional concepts and designs of the prior art, and in doing so provides an apparatus primarily developed for the purpose of providing a box that holds one large gift and further including pockets for holding twelve smaller gifts.

Therefore, it can be appreciated that there exists a continuing need for a new and improved gift container which can be used for providing a box that holds one large gift and further including pockets for holding twelve smaller gifts. In this regard, the present invention substantially fulfills this need.

SUMMARY OF THE INVENTION

In view of the foregoing disadvantages inherent in the known types of boxes now present in the prior art, the present invention provides an improved gift container. As such, the general purpose of the present invention, which will be described subsequently in greater detail, is to provide a new and improved gift container and method which has all the advantages of the prior art and none of the disadvantages.

To attain this, the present invention essentially comprises a lid that has a top portion with four peripheral side walls. Included is a bottom member that has a base portion with four peripheral side walls. The bottom member has at least four common corner edges that are formed by interconnecting adjacent side walls of the bottom member. The four peripheral side wall are interconnected at the common corner edges to form the bottom member into a box-like structure. The bottom member has a :shelf within an interior of the bottom member. The shelf is spaced from the base portion and parallel with the base portion. The shelf is attached to the side walls and capable of supporting a large gift member within the bottom member. Lastly, a plurality of holders are provided. Each holder has at least three pocket parts. Each holder has a front wall, a bottom end and a pair of dividers. The bottom end of each holder is attached to one of the side walls of the bottom member. Each holder has a pair of accordion-like side walls connected to the front wall and the pair of dividers. Each accordion-like side wall of each holder has a back edge that is attached to the common corner edges of the side walls of the bottom member. Each accordion-like side wall is attached to the bottom end and capable of allowing expansion and retraction of the respective holder. Whereby, when the holders is retracted the bottom member is in receipt of the lid. Additionally, when the lid is removed form the bottom member the holders expand for receipt of smaller gift members.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gift container which has all of the advantages of the prior art boxes and none of the disadvantages.

It is another object of the present invention to provide a new and improved gift container which may be easily and efficiently manufactured and marketed.

It is further object of the present invention to provide a new and improved gift container which is of durable and reliable constructions.

An even further object of the present invention is to provide a new and improved gift container which is susceptible of a low cost of manufacture with regard to both materials and labor, and which accordingly is then susceptible of low prices of sale to the consuming public, thereby making such gift container economically available to the buying public.

Even still another object of the present invention is to provide a gift container for providing a box that holds one large gift and further including pockets for holding twelve smaller gifts.

Lastly, it is an object of the present invention to provide a new and improved gift container including a lid. Also, included is a bottom member. The bottom member has a base portion with four peripheral side walls integral therewith and interconnected one to another to form a box-like structure that is capable of being covered by the lid. Lastly, a plurality of holders are provided. Each holder has a front wall and a bottom end that is attached to one of the side walls of the bottom member. Each holder has a pair of accordion-like side walls that are connected to the front wall and the side walls of the bottom member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the gift container constructed in accordance with the principles of the present invention.

FIG. 2 is an exploded view of the present invention of FIG. 1.

The same reference numerals refer to the same parts through the various Figures.

DESCRIPTION OF THE PREFERRED EMBODIMENT

Figure 3:
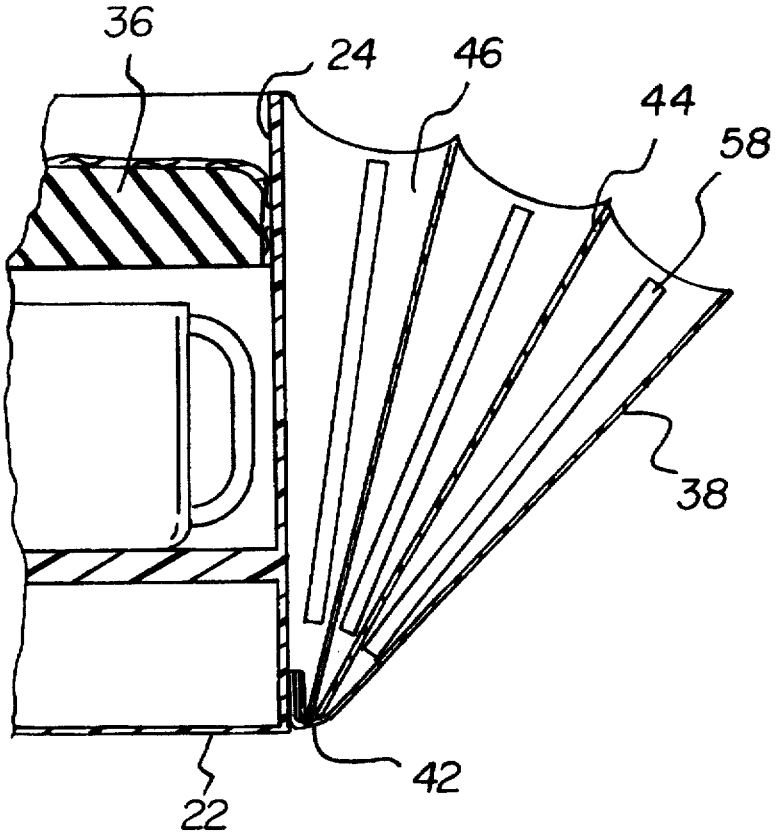
FIG. 3 is a cut-away cross-sectional view of the pockets of the present invention.

With reference now to the drawings, and in particular to FIG. 1 thereof, the preferred embodiment of the new and improved gift container embodying the principles and concepts of the present invention and generally designated by the reference numeral 10 will be described.

The present invention, the gift container 10 is comprised of a plurality of components. Such components in their broadest context include a lid, a bottom and holders. Such components are individually configured and correlated with respect to each other so as to attain the desired objective.

Specifically, the present invention includes a lid 12. The lid has a top portion 14 with four peripheral side walls 16 that are integral the top portion. The lid, as seen in FIG. 1, may be formed of paper, cardboard, wood or plastic.

Also, a bottom member 20 is provided, The bottom member has a base portion 22 with four peripheral side walls 24 that are integral the base portion. The bottom member of FIG. 2 is formed of the same material used to make the lid. The bottom member has at least four common corner edges 26 that are formed by interconnecting adjacent side walls 24 of the bottom member. The four peripheral side walls are interconnected at the common corner edges and form the bottom member into a box-like structure. The bottom member of the present invention is not limited to the box-like shape as depicted in the Figures. The bottom member could have a rectangular shape.

Figure 6:
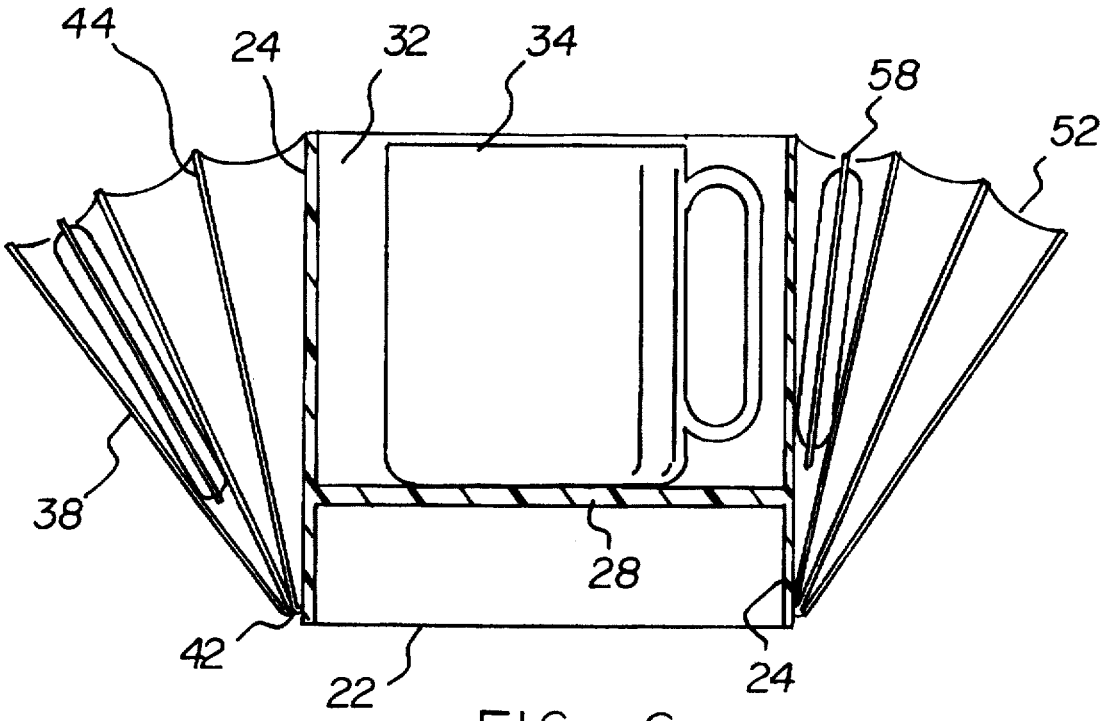
FIG. 6 is a cross-sectional view of FIG. 2 of the bottom member of the present invention.

The bottom member 20 has a shelf 28 within an interior 32 of the bottom member as seen in FIG. 6. The shelf is spaced from the base portion and parallel. The shelf is attached to the side walls 24 of the bottom member. The shelf is capable of supporting a large gift 34 member within the bottom member. The present invention depicts the large gift member as a coffee mug. The large gift member is not limited to a coffee mug. It is to be understood that the gift member is not required to be as large as a coffee mug. A foam pad 36 may be placed over the large gift to protect it from damage when the lid covers the bottom member.

As best illustrated in FIG. 2, a plurality of holders 36 are provided. Each holder has pocket parts formed within. Each holder has a front wall 38, a bottom end 42 and a pair of dividers 44 positioned within each holder. The pair of dividers section the pocket parts into at least three pockets 46 within each holder. Twelve is the total number of pockets formed around the side walls of the bottom member. The bottom end of each holder is folded under and fixedly attached to one of the side walls of the bottom member, as seen in FIG. 3. Each holder has a pair of accordion-like side walls 52 connected to the front wall and the pair of dividers. Each accordion-like side wall has a back edge 54 that is attached to the common corner edges of the side walls of the bottom member.

Each accordion-like side wall is attached to the bottom end 42 and allows expansion and retraction of the respective holder 36. The accordion-like side walls are formed from fabric, paper or plastic. Whereby, when the holders are retracted the bottom member is capable of receiving the lid, and when the lid is removed from the bottom member the holders expand. The expansion of the holders allows each pocket part formed by the dividers to receive a smaller gift member 58.

Figure 4:
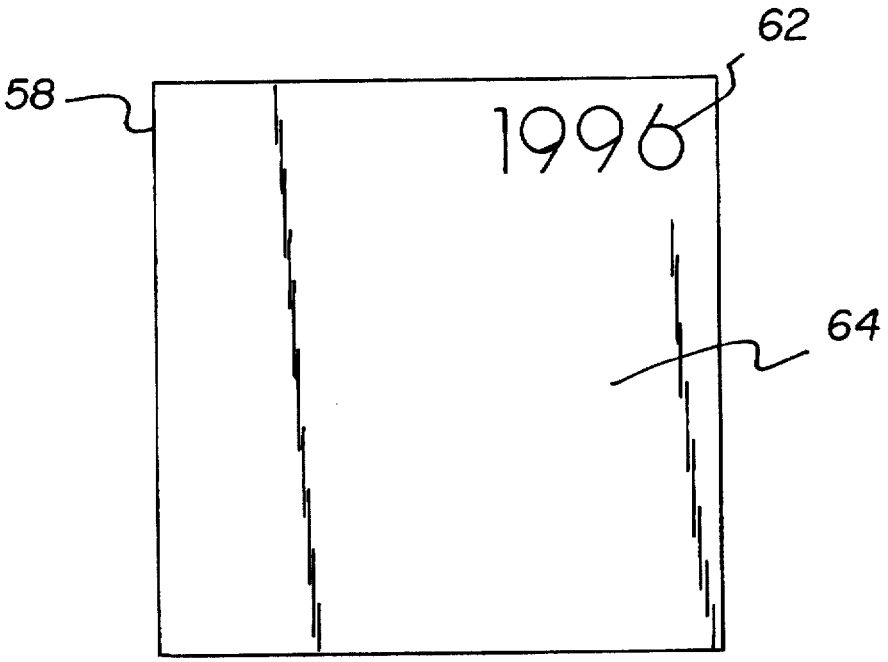
FIG. 4 is an envelope for placement in a pocket of the invention of FIG. 2.
Figure 5:
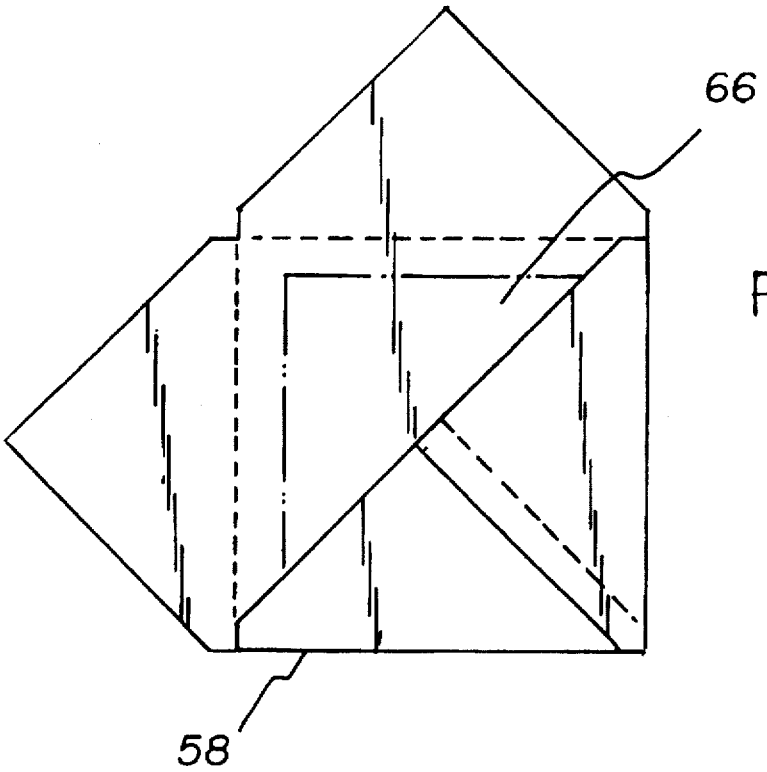
FIG. 5 is an to plan view of the envelop of FIG. 4 in an operable configuration.

Furthermore, the smaller gift member is in the from of an envelope 58 that hold the small gift member. FIG. 4 shows an envelop with a dated 62 on the front 64. FIG. 6 shows the envelope being a pouch of coffee. FIG. 5 shows the envelop holding a photo 66. These figures depict some of the various small gift member types that may be positioned within the holders. One small gift may be place in each one of the twelve pockets of the bottom member. The bottom member, with the large gift and the twelve small gifts, is covered by the lid 12 for presenting to a person.

The gift container of the present invention is a specialized gift box that is used to give a series of gifts. The gifts may be given for opening at that moment or for opening twelve months or years later. The bottom member has the interior with a shelf for holding the main gift or larger gift. Attached to each side wall of the bottom member is a holder that is sectioned into a plurality of pockets. Each holder has accordion-like side walls that expand and retract as the lid is removed from the bottom member or placed over the bottom member. Each pocket of the holder is filled with a small gift. The gift giver may imprint the lid with the day, month, and year, and the date in each successive year that one of the small gifts is to be opened. Each small gift may be imprinted with an opening date.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved gift container for holding a plurality of gifts separately comprising in combination:

a lid having a top portion with four peripheral side walls integral therewith;

a bottom member having a base portion with four peripheral side walls integral therewith, the bottom member having at least four common corner edges being formed by interconnecting adjacent side walls of the bottom member, the four peripheral side walls being interconnected at the common corner edges for forming the bottom member into a box structure, the bottom member having a shelf within an interior thereof, the shelf being spaced from the base portion and parallel therewith, the shelf being attached to the side walls and capable of supporting a large gift member within the bottom member; and a plurality of holders with each having at least three pocket parts, each holder having a front wall, a bottom end and a pair of dividers within, the bottom end of each holder being attached to one of the side walls of the bottom member, each holder having a pair of accordion side walls connected to the front wall and the pair of dividers, each accordion side wall of each holder having a back edge being attached to the common corner edges of the side walls of the bottom member, each accordion side wall being attached to the bottom end and capable of allowing expansion and retraction of the respective holder, whereby when the holders being retracted the bottom member being in receipt of the lid, and when the lid being removed from the bottom member the holders expand for receipt of smaller gift members.

2. A gift container comprising:

a lid;

a bottom member having a base portion with four peripheral side walls integral therewith and interconnected one to another for forming the bottom member into a box structure that is capable of being covered by the lid, the bottom member having at least four common corner edges being formed by interconnecting adjacent side walls of the bottom member, the bottom member having a shelf within an interior thereof and spaced from the base portion, the shelf being attached to the side walls and capable of supporting a large gift member within the bottom member; and a plurality of holders with each holder having a front wall and a bottom end being attached to one of the side walls of the bottom member, each holder having a pair of accordion side walls connected to the front wall and the side walls of the bottom member.

3. The gift container as set forth in claim 2, wherein the front wall and each accordion side wall of each holder having a back edge being attached to the common corner edges of the side walls of the bottom member.

4. The gift container as set forth in claim 2, wherein each holder having a pair of dividers within and attached to the accordion side walls to form at least three pocket parts within each holder, and each pocket part being capable of having a smaller gift member positioned within.

5. The gift container as set froth in claim 4, wherein each accordion side wall being attached to the bottom end and capable of allowing expansion and retraction of the respective holder.

6. The gift container as set froth in claim 5, wherein each holder being retracted when the bottom member being in receipt of the lid, and each holder being expanded when the lid being removed from the bottom member.

* * * * *